United States Patent [19]

Sherman

[11] Patent Number: 4,503,659

[45] Date of Patent: Mar. 12, 1985

[54] METHOD OF GLUING END FLAPS OF A PACKAGE IN AN IN-LINE PACKAGING MACHINE

[75] Inventor: Earle C. Sherman, West Monroe, La.

[73] Assignee: Manville Service Corporation, Denver, Colo.

[21] Appl. No.: 376,856

[22] Filed: May 10, 1982

[51] Int. Cl.[3] ..... B65B 7/20

[52] U.S. Cl. ..... 53/491; 53/374; 53/383

[58] Field of Search ..... 53/209, 374, 383, 484, 53/491; 118/314, 315, 324; 493/130, 131, 141, 142, 150, 151, 177, 180, 182, 183, 333

[56] References Cited

U.S. PATENT DOCUMENTS

| | | | |
|---|---|---|---|
| 733,460 | 7/1903 | Cormack | 493/151 X |
| 2,349,204 | 5/1944 | Staude | 493/130 |
| 3,406,493 | 10/1968 | Katgir | 53/209 X |
| 3,482,489 | 12/1969 | Neal et al. | 53/374 X |
| 3,762,132 | 10/1973 | Owen | 53/383 X |
| 4,010,203 | 3/1977 | Aylon | 118/315 X |
| 4,215,525 | 8/1980 | Nigrelli | 53/209 X |

FOREIGN PATENT DOCUMENTS

| | | | |
|---|---|---|---|
| 2037697 | 7/1980 | United Kingdom | 493/131 |

*Primary Examiner*—John Sipos
*Assistant Examiner*—Steven P. Weihrouch
*Attorney, Agent, or Firm*—John D. Lister; Timothy R. Schulte

[57] ABSTRACT

An improved method of gluing a package in an in-line packaging machine. The package is of the type having a plurality of leading and trailing end flaps which are glued to be together during the packaging process. The novel method comprises in part providing at least two glue nozzles in the line of the packaging machine direction with one glue nozzle facing downwardly and upstream while the other glue nozzle faces downwardly and downstream so that the glue is applied to a pair of the end flaps by one nozzle in an upwardly direction and by the other nozzle in a downwardly direction as the package is moved through the packaging machine past the glue nozzles. Subsequently thereafter, the other pair of end flaps are turned inwardly and are held in position after being glued until the glue sets. The four flaps of the package are turned inwardly by a first and a second flap closing means.

1 Claim, 9 Drawing Figures

UPSTREAM PACKAGING OF PRODUCT

METHOD OF GLUING END FLAPS OF A PACKAGE IN AN IN-LINE PACKAGING MACHINE

BACKGROUND OF THE INVENTION

This invention relates generally to packaging machinery and more specifically to a new and novel method of gluing a plurality of end flaps of a package moving downstream in an in-line packaging machine.

In the packaging of a plurality of cans or bottles of beverage in a packaging machine of the type wherein the plurality of cans or bottles are either placed within an open package or an opened blank is wrapped around the bottles, problems have been encountered in the folding and gluing of the end flaps of the package where those types of flaps are utilized. The problems are encountered because of the difficulty of placing hot melt adhesive in the proper position as the package is moving downstream in the packaging machine and subsequently closing the flaps and holding the flaps in a closed position until the adhesive sets. Such gluing requires either complicated nozzle arrangements, nozzle positioning and moving pressure arms in order to obtain a desired result.

SUMMARY OF THE INVENTION

In order to overcome the problems inherent in prior art types of gluing sections of packaging machines there is provided by the subject invention a new and novel method of gluing a plurality of end flaps of the package in an in-line packaging machine.

The package desired to be glued is positioned in the packaging machine traveling downstream longitudinally with a pair of front flaps leading the package and a pair of rear flaps trailing the package. There is provided in the Applicant's novel method a plurality of glue nozzles and at least one source of glue with the glue nozzles being positioned in the line of the packaging machine. One glue nozzle is facing downwardly and upstream aimed at the leading end of the package while the other glue nozzle is facing downwardly and downstream aimed at the trailing flap of the package.

There is provided a first nozzle closing means adjacent to the moving package in the form of a horizontally rotating conveyor chain positioned on one side of the packaging machine. The first flap closing means contains a plurality of folding arms which are designed to fold one leading and one trailing flap of the moving package inwardly prior to the glue nozzles being activated. After the one leading flap and one trailing flap are folded inwardly, the glue nozzles are activated to apply a narrow glue path near the edge of the flaps. Since the package is traveling downstream, the one glue nozzle applies the glue to the leading flap in an upwardly moving direction while the other glue nozzle applies the glue to be trailing flap in a downwardly moving manner.

There is also provided by the Applicant's novel method, a second flap closing means adjacent to the moving package which comprises in part a pair of vertically rotating conveyor chains positioned on the other side of the package and having fixed thereto a plurality of pivotable folding linkages and folding pressure arms which are spring biased. The second flap closing means thereby folds and closes the remaining leading and trailing flap across the first folded leading the trailing flap and holds the remaining leading and trailing flap against the first folded leading and trailing flap until the adhesive sets. This is accomplished while the packages are moving downstream in the packaging machine and with both the first flap closing means and the second flap closing means being timed to synchronize with the movement of the in-line packaging machine. After the adhesive has set on the package, then the second flap closing means releases the pressure on the forward pair of leading flaps and rear pair of trailing flaps so that the package can continue its motion downstream in the packaging machine.

Accordingly, there is provided by the subject application a new and novel method of gluing a plurality of end flaps in a package traveling in an in-line packaging machine which allows predetermined minimal amounts of adhesive to be applied to leading and trailing flaps which had previously been positioned across the ends of the package.

Another object and advantage of the invention is to provide a new and novel gluing method which utilizes a pair of rotating conveyors located on each side of the downstream traveling package which are utilized in conjunction with the novel placement of a pair of glue nozzles in the in-line position of the gluing machine to thereby provide a positive closing, gluing and release of the flaps of the package whenever the adhesive is set.

These and other objects and advantages of the invention will become apparent from a review of the drawings and from a study of the preferred embodiment hereinafter which is given by way of illustration only.

DESCRIPTION OF THE PREFERRED EMBODIMENT

Figures 1, 2, 3, 4, 5, 6, 7:
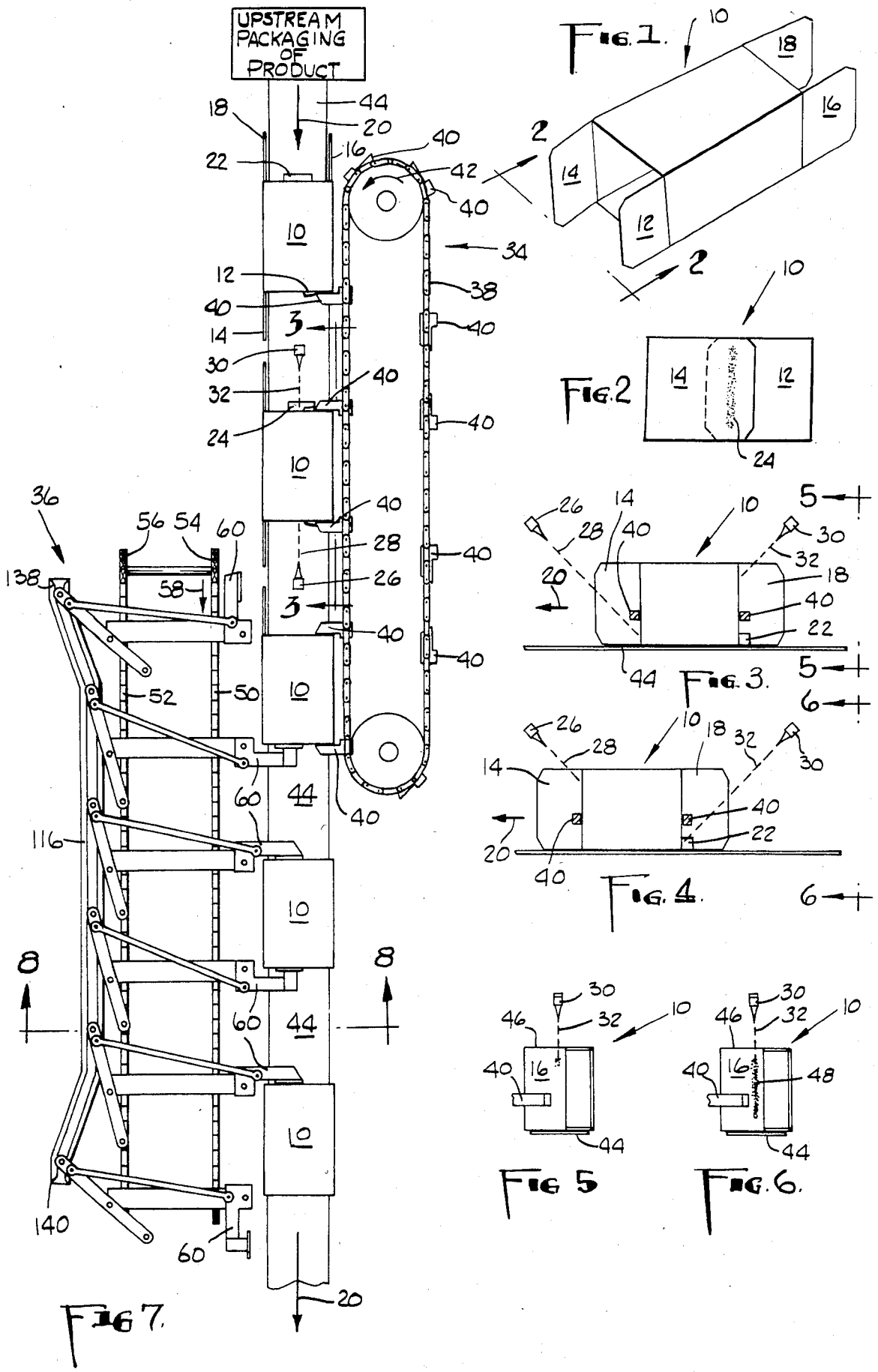
FIG. 1 is a prespective view of one type of package capable of being glued by the method disclosed herein showning a pair of leading end flaps and a pair of trailing end flaps on the package.
FIG. 2 is an end view, taken along line 2—2 of FIG. 1, showing the end flaps of the package closed and also showing a narrow path of glue which has been applied between the end flaps by the method herein disclosed.
FIG. 3 is a side sectional view, taken along line 3—3 of FIG. 7 showing a leading and trailing end flap of the package being folded inwardly and also showing the positioning of the pair of glue nozzles utilized in the Applicant's invention.
FIG. 4 is a sectional side view similar to FIG. 3 showing the package as positioned in FIG. 3 having moved downstream a short distance and showing how the pair of nozzles positioned as shown apply the adhesive in an upwardly and downwardly manner as will be described more fully hereinafter.
FIG. 5 is an end view, taken along line 5—5 of FIG. 3 showing in further detail the positioning of one trailing end flap of the package and showing the beginning of application of the rear or trailing glue nozzle as it initially applies adhesive to the end flap.
FIG. 6 is an end view, taken along line 6—6 of FIG. 4 showing the completion of the application of adhesive by the glue nozzle to the one trailing flap of the package shown in FIG. 5.
FIG. 7 is a top plan view of the placement of the various conveyors and glue nozzles on the in-line packaging machine.

Referring now to the drawings in general and in particular to FIGS. 1 and 2 of the drawings, there is shown in FIG. 1 a perspective view of a typical type of package utilized with the Applicant's novel method. The package may have various panels and flaps and may be of various configurations but would be typically formed such as the package shown generally by the numeral 10. The package 10 would have a plurality of flaps 12 and 14 on one end of the package and a plurality of flaps 16 and 18 on the other end thereof. In the packaging machine utilizing the Applicant's novel method, there would be provided upstream packaging of the product such as cans or bottles into the package 10 and the filled package would be transported downstream in the packaging machine as shown by the arrow 20 in FIGS. 3, 4, 7 and 9 of the drawing. The package 10 would be conveyed downstream in the packaging machine by means of a plurality of flight bars as is known in the art of conveying packages. The flight bars 22 would be positioned at the rear or trailing end of the package and would serve the purpose of moving the package 10 downstream in the direction shown by the arrow 20.

Referring now to FIG. 2 of the drawing, there is shown an end view, taken along line 2—2 of FIG. 1, showing the type of package 10 which would be utilized in te Applicant's new method. It can be seen in FIG. 2 that the first leading flap 12 would preferably be first turned inwardly. Thereafter, a predetermined amount of glue would be applied in a narrow glue path as shown by the stippled area 24. Thereafter, the other leading flap 14 would be turned inwardly to be adhesively secured to the first leading flap 12. The adhesive 24 is thereby positioned between the flaps 12 and 14.

Referring now to FIGS. 3, 4, 5 and 6 of the drawings, there will be described in detail how one feature of the Applicant's novel method operates in order to alleviate the problems with the prior art type methods hereinbefore described. It can be seen in FIG. 3 that there is positioned above the package 10 a glue nozzle 26 which is fixedly attached to a frame not shown in the drawing. The glue nozzle 26 is positioned so as to face downwardly and upstream of the packaging machine so that it ejects its glue in a glue path shown by the dashed line 28. There is also positioned a second glue nozzle 30 which is positioned above the package 10 and is facing downwardly and downstream so as to eject its glue in the glue path shown by the dashed lines and the numeral 32.

Referring now also to FIG. 7 and FIGS. 3, 4, 5 and 6, it can be seen that there is provided a first flap closing means shown generally by the numeral 34 and a second flap closing means shown generally by the numeral 36. The first flap closing means comprises a horizontally rotating conveyor chain 38 which is positioned on one side of the packaging line and has fixed thereto a plurality of folding arms 40. The folding arms 40 are actuated by means known in the art and are designed to extend outwardly as shown in FIG. 7 at an appropriate time in order to fold the leading flap 12 and the trailing flap 16 on one side of the package inwardly against the package prior to the package passing into the vicinity of the glue nozzles 26 and 30. The conveyor chain 38 is designed for rotation in the direction shown by the arrow 42 and is actuated and controlled by well known conveyor actuating means such as a motor or other means.

As the package 10 passes downstream in the packaging line it is slid along the flat plate 44 by means of the flight bar 22 as has been beforementioned. As shown in FIGS. 5, 6 and 7, once the package 10 passes downstream to the first flap closing means 34 the package is slid along flat plate 44 by the arms 40 of the first flap closing means. It can be seen in FIGS. 3, 4, 5 and 6 how the package 10 moves into the vicinity of the glue nozzles 26 and 30. Since the glue nozzles 26 and 30 are preferably fixed in the position shown in FIG. 3, then it becomes apparent that as the package 10 passes downstream in the direction shown by the arrow 20 that the glue path 28 of the glue ejecting from the nozzle 26 will travel upwardly on the front or leading flap 12 while the glue path 32 of the rear nozzle 30 will travel downwardly on the trailing flap 16. The condition of travel of the package 10 from one position to a downstream position in order to enable the glue to be applied is shown by studying FIG. 3 which is an upstream position of the package while FIG. 4 is the immediate downstream position of the package. Whenever the package 10 reaches the position shown in FIG. 4, the glue nozzles 26 and 30 would stop ejecting glue until the next package approaches the area of the glue nozzles. The ejection of the glue from the glue nozzles can be controlled by mechanical switches, photoelectric devices or other means known in the art of control.

By referring to FIGS. 5 and 6, there can be seen end views taken along lines 5—5 of FIG. 3 and taken along lines 6—6 of FIG. 4 showing the trailing end of the package. It can be seen in FIG. 5, for example, that the glue nozzle 30 of thetrailing end of the package would start applying glue at the upper portion 46 of the package 10 and as the package 10 travels downstream in the direction shown by the arrow 20, the glue path would be applied downwardly on the panel 16 to complete the glue path 48 as shown in FIG. 6. It should then become apparent that the leading edge of the package would have the glue path applied in the opposite direction as has been beforementioned starting at the bottom of the package and traveling upward along the glue flap 12 as the package passes downstream in the direction shown by the arrow 20. The glue path 48 in FIG. 6 would be similar to the glue path shown by the stippled area 24 in FIG. 2 as applied to the front or leading flaps.

Figure 9:
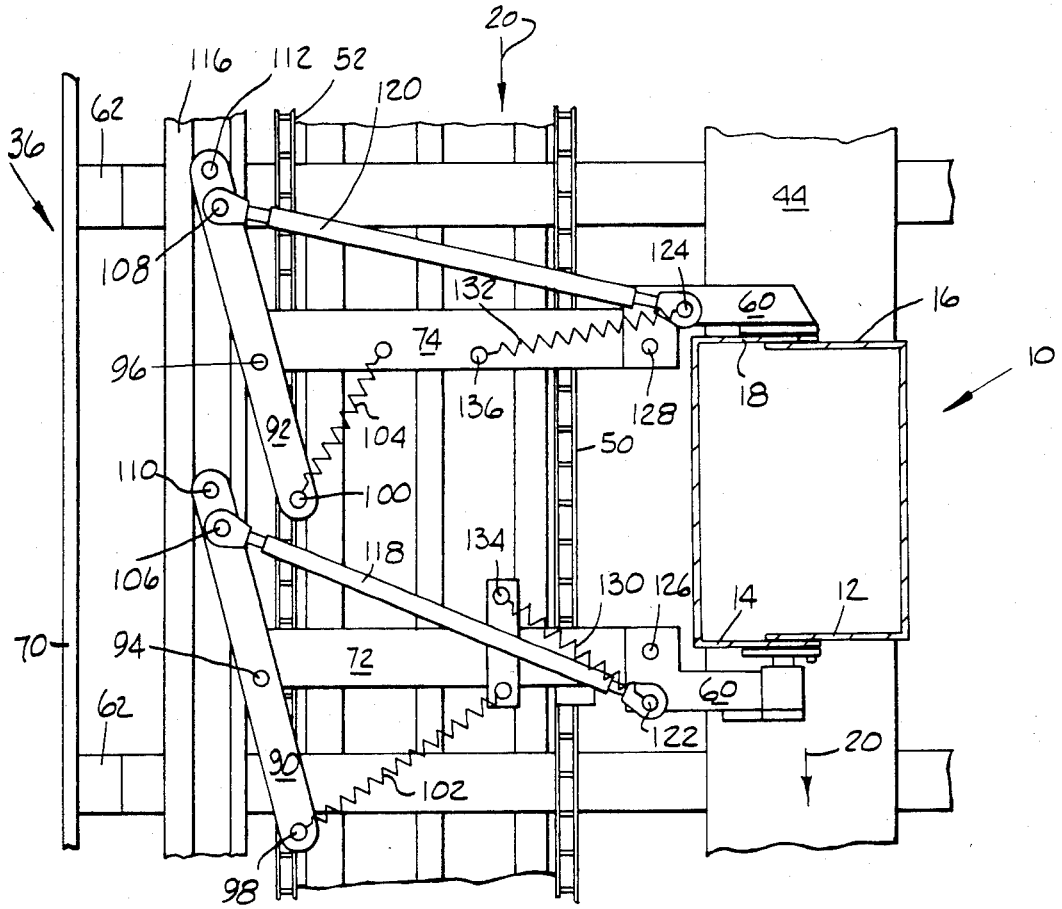
FIG. 9 is a top plan view, taken along line 9—9 of FIG. 8 showing in further detail the plurality of pivotable folding linkages and folding pressure arms and showing the spring bias on the various arms which are utilized to apply pressure to the flaps until the package is completely set up.
Figure 8:
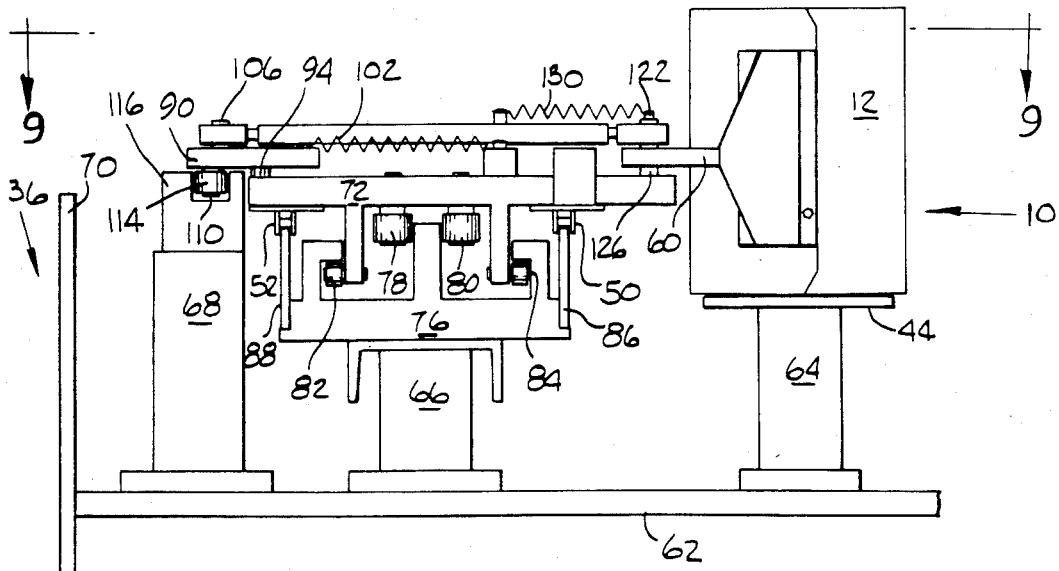
FIG. 8 is a sectional view, taken along line 8—8 of FIG. 7 showing in detail the second flap closing means utilized to close and hold pressure on the second pair of flaps of the package.

Referring now to FIG. 7 of the drawing, there can be seen the second flap closing means 36 which comprises in part a pair of vertically rotating conveyor chains 50 and 52 which rotate around a plurality of sprockets 54 and 56 and which would be controlled by means known in the art of controlling conveyor chains such as electrical motors and the like. The vertical conveyor chains 50 and 52 would be timed to travel in the direction shown by the arrow 58 and would be timed to travel at the same speed as the first flap closing means 34 and the packaging line proper which is traveling in the direction shown by the arrow 20 by means of the flight bars 22. The vertical conveyor chains 50 and 52 of the second flap closing means 36 control a plurality of pivotable folding linkages and folding pressure arms 60 which are designed to be timed to fold the leading flap 14 and the trailing flap 18 across the leading flap 12 and the trailing flap 16 after the glue has been applied by means of the glue nozzles 28 and 30. The folding pressure arms 60 are spring biased as will be described more fully hereinafter when referring to FIGS. 8 and 9 of the drawing in order to apply pressure to the leading flap 14 and the trailing flap 18 so that the previously applied adhesive can properly adhere the leading flaps 12 and 14 together and the trailing flaps 16 and 18 together. As shown in FIGS. 7, 8 and 9, once the package 10 passes downstream to the second flap closing means 36, the package is slid along flat plate 44 by the arms 60 of the second flap closing means.

Referring now to FIGS. 8 and 9, there is shown in greater detail the second flap closing means 36 comprising the conveyor chains 50 and 52 and the pivotable folding linkages and folding pressure arms 60. It can be seen in FIG. 8 that the second flap closing means 36 comprises a generally horizontal frame structure 62 which is adhered to the frame 64 of the in-line packaging machine. The frame 64 supports the flat plate 44 upon which the package 10 is moved by the flight bars 22. The frame 62 also supports a frame 66 and a frame 68 to support the pivotable folding linkages and folding pressure arms to be described hereinafter. The horizontal frame 62 may then be fixedly attached to a vertical frame 70 as shown.

A plurality of elongated arms 72 and 74 are mounted on the vertical conveyor chains 50 and 52 adjacent to each other and are fixedly attached to the conveyor chains so that the arms 70 and 72 may be horizontally moved as the conveyor chains 50 and 52 move. The support for the elongated arms 72 and 74 and the other arms 72 and 74 connected to the vertical conveyor chains 50 and 52 but not shown in FIGS. 8 and 9 is achieved by means of an upstanding frame 76 which is used as bearing surfaces for the horizontally positioned rollers 78 and 80 and the vertically positioned rollers 82 and 84 which are all rotatably connected to the elongated arms 72 and 74 as is known in the art. The conveyor chains 50 and 52 are designed to roll or slide over the vertical plates 86 and 88 which are fixedly attached to the bottom portion of the frame 76.

Refering now also to FIG. 9 as well as to FIG. 8, there can be seen the various pivotable folding linkages and folding pressure arms hereinbefore described. It can be seen in FIG. 9 that the elongated horizontally positioned arms 72 and 74 have pivotable folding linkages 90 and 92 attached thereto by means of the pins 94 and 96. On one end of the linkages 90 and 92 would be provided an upwardly depending pin 98 and 100 designed to receive one end of a spring bias 102 and 104. The other end of the linkages 90 and 92 would have an upwardly depending pin 106 and 108 as well as a downwardly depending shaft 110 and 112. Each of the downwardly depending shaft 110 and 112 have positioned thereon a horizontally positioned roller 114 which is shown in FIG. 8 of the drawing but cannot be seen in FIG. 9. Each shaft 110 and 112 would have positioned thereupon a roller 114 which is designed to roll within the cam 116 which is designed to activate the various folding linkages and pressure arms so as to cause the pressure arms 60 to fold the leadig flaps 14 and trailing flaps 18 across the package and to apply pressure on the flap structure until the glue has set in the package.

A linkage arm 118 and 120 are rotatably attached to the pins 10 and 108 on one end thereof and also to the pins 122 and 124 on the other end thereof. The pins 112 and 124 are positioned within the folding pressure arms 60 as has been beforementioned. The pins 122 and 124 are fixedly attached to the horizontally positioned folding pressure arms 60 and the horizontally positioned folding pressure arms 60 are rotatably attached to the horizontally positioned elongated arms 72 and 74 by means of the pins 126 and 128. A spring bias 130 and 132 is applied to the pins 122 and 124 on one end thereof and also to the pins 134 and 136 on the other end thereof to bias the folding pressure arms 60 against the leading flaps 12 and 14 and the trailing flaps 16 and 18.

By referring to FIG. 7 along with FIGS. 8 and 9, there can be seen the configuration of the cam 116 which is positoned parallel to the vertical conveyor chains 50 and 52 and which has a converging upstream end 138 and a diverging downstream end 140. It is apparent then that the rollers 114 of each group of pivotable folding linkages and folding pressure arms would enter into the cam 116 at the converging upstream end 138 and would travel in the cam 116 until it leaves the cam 116 at the diverging downstream end 140. Such motion would then act to activate the folding pressure arms 60 to move into position to fold the flaps 14 and 18 and also to release the flaps 14 and 18 whenever the package 10 would leave the area of the second flap closing means 36. The plurality of pairs of pivotable folding linkages and folding pressure arms 60 would travel around the vertical conveyor chains 50 and 52 in an endless manner similar to the endless manner than the folding arms 40 to travel around the conveyor chain 38 of the first flap closing means.

From the foregoing, it can be seen then that the Applicant's novel method of gluing a plurality of end flaps of a package in an in-line packaging machine comprises the steps of providing at least two glue nozzles and at least one source of glue for the glue nozzles, with the glue nozzles being positioned in the line of the packaging machine with one glue nozzle facing downwardly and upstream and the other glue nozzle facing downwardly and downstream. A first flap closing means would be provided adjacent to the package and the package would be moved downstream in the packaging machine by the packaging machine flight bar with a leading and trailing end flap on one side of the package being folded and closed traversely across the package with the flap closing means while continuing to move the package downstream by the arms 40 of the first flap closing means. Thereafter, a predetermined quantity of adhesive would be applied to the folded leading and trailing end flap from the glue nozzles and from the glue source with the one glue nozzle applying glue from the bottom of the folded leading flap to the top thereof and the other glue nozzle applying glue from the top of the folded trailing flap to the bottom thereof while continuing to move the package downstream in the packaging machine by means of the arms 40 of the first flap closing means.

A second flap closing means would be provided adjacent to the moving package and on the other side of the packaging line and would be utilized to fold the remaining leading and trailing end flaps on the other side of the package transversely across the package and across the previously folded flaps. This would be accomplished while continuing to move the package downstream by the arms 60 of the second flap closing means. The second flap closing means would also apply pressure to the previously folded flaps until the glue sets between the flaps while the package is being continued to be moved downstream in the packaging machine by the flight bar. Thereafter, pressure on the package flaps would be released by the second flap closing machine and the package would continue to move downstream in the packaging machine.

It should become apparent that there has been provided by the subject invention a new and improved method of gluing a package in an in-line packaging machine. It should also become apparent that the embodiment shown has been given by way of illustration only and other steps may be added to the method without departing from the spirt and scope of the invention.

Having described my invention, I claim:

1. A method of gluing a plurality of end flaps of a package in an in-line packaging machine, the package traveling in a horizontal path from an upstream position to a downstream position in the packaging machine, the package comprising a sleeve having a top panel, a bottom panel, first and second side panels, a pair of downstream or leading end flaps hingedly attached to leading ends of the side panels and a pair of upstream or trailing end flaps hingedly attached to trailing ends of the side panels, comprising the steps of:

(a) providing an upstream stationary glue nozzle and a downstream stationary glue nozzle and at least one source of glue, the stationary glue nozzles being positioned in the line of travel of the package in the packaging machine, the downstream glue nozzle facing downwardly and upstream, the upstream glue nozzle facing downwardly and downstream;

(b) providing a first flap closing means adjacent to the package on one side of the packaging machine and movable along said horizontal path;

(c) moving the package downstream in the packaging machine by means of a packaging machine flight bar to the first flap closing means;

(d) folding and closing the leading and trailing end flaps which are hingedly attached to the first side panel of the package transversely across the package with the first flap closing means while continuing to move the package downstream by means of the first flap closing means;

(e) applying a predetermined quantity of adhesive to the folded and closed leading and trailing end flaps from the stationary glue nozzles and the glue source, the downstream glue nozzle applying glue from the bottom of the folded and closed leading flap to the top thereof, the upstream glue nozzle applying glue from the top of the folded and closed trailing flap to the bottom thereof, while continuing to move the package downstream in the packaging machine by means of the first flap closing means;

(f) providing a second flap closing means adjacent to the package on the other side of the packaging machine and movable along said horizontal path;

(g) folding and closing the leading and trailing end flaps which are hingedly attached to the second side panel of the package transversely across the package and across the previously folded and closed leading and trailing flaps with the second flap closing means, while continuing to move the package downstream by means of the second flap closing means;

(h) applying pressure on the pairs of previously folded leading and trailing end flaps by the second flap closing means until the glue sets, while continuing to move the package downstream in the packaging machine by means of the second flap closing means; and (i) releasing the pressure on the pairs of leading and trailing end flaps after the glue sets while continuing to move the package downstream in the packaging machine by means of the second flap closing means.

* * * * *